US006666446B2

(12) United States Patent
Gaarder et al.

(10) Patent No.: US 6,666,446 B2
(45) Date of Patent: Dec. 23, 2003

(54) REPLACEABLE ROLLER BOGIE FOR DOCUMENT FEEDING APPARATUS

(75) Inventors: Glenn Gaarder, Ramona, CA (US); Mark Randolph Marrs, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/880,407

(22) Filed: Jun. 13, 2001

(65) Prior Publication Data

US 2002/0190459 A1 Dec. 19, 2002

(51) Int. Cl.[7] ..... B65H 5/00

(52) U.S. Cl. ..... 271/10.04; 271/10.13; 271/116; 271/117

(58) Field of Search ..... 271/117, 118, 271/109, 122, 121, 116, 10.13, 10.04

(56) References Cited

U.S. PATENT DOCUMENTS

| | | | | | |
|---|---|---|---|---|---|
| 5,421,569 | A | * | 6/1995 | Davidson | 271/117 |
| 5,709,380 | A | * | 1/1998 | Petocchi et al. | 271/117 |
| 5,769,410 | A | * | 6/1998 | Davidson et al. | 271/109 |
| 5,882,002 | A | * | 3/1999 | Kamei et al. | 271/118 |
| 5,921,539 | A | * | 7/1999 | Westcott et al. | 271/121 |
| 6,024,356 | A | * | 2/2000 | Tanaka et al. | 271/118 |

* cited by examiner

*Primary Examiner*—David H. Bollinger

(57) ABSTRACT

A replaceable roller bogie for a single sheet feeder includes pre-feed and separation rollers mounted on a frame which also has a frame positioning lever thereon. Roller drive gears are mounted between spaced plates on the frame and include a pre-feed roller clutch gear with elastomeric teeth which is mounted in slots on the frame which limit motion travel of the clutch gear to prevent over engagement of gear teeth on the clutch gear with gear teeth on the pre-feed roller drive gear. The replaceable bogie is pivotally supported on the sheet feeder and held in place by a manually operable release and latch mechanism.

20 Claims, 18 Drawing Sheets

REPLACEABLE ROLLER BOGIE FOR DOCUMENT FEEDING APPARATUS

CROSS REFERENCE TO RELATED APPLICATIONS

None.

1. Background of the Invention

The present invention relates generally to the art of document processing equipment such as scanners, printers, facsimile machines and combination devices which use single sheet feeders to pick single sheets of media to be processed from a stack thereof. Such equipment includes sheet moving rollers, belts or wheels and, in particular, the sheet feeders with which the present invention is concerned employ both a pre-feed roller and a separation roller spaced downstream from the pre-feed roller. A stack stop is positioned to be moved into and out of the path of sheet movement between the rollers. Worn or otherwise damaged rollers in such equipment occasionally require replacement necessitating a service call and attendant expense. It is accordingly desirable to provide a modular single sheet feeder which can be easily assembled at the factory and which also has easily replaceable rollers which can be serviced by the user without the necessity to involve a skilled service technician.

2. Summary of the Invention

The present invention therefore provides a roller bogie for a single sheet feeder, said bogie comprising:

a) a frame;

b) a pre-feed roller rotatably supported on said frame;

c) a single sheet separation roller rotatably supported on said frame; and d) roller drive gears rotatably mounted on said frame, and e) axially aligned spaced bogie support bearings on said frame, said bearings being configured for reception in spaced bogie supports in a single sheet feeder.

The present invention further provides a method of replacing sheet transport rollers in a sheet feeder comprising the steps of:

a) providing a roller bogie having sheet transport rollers thereon, b) mounting said bogie on bogie support structure in a sheet feeder, said support structure including a latch for securely holding said bogie on said support structure;

c) releasing said latch and removing said bogie from said sheet feeder apparatus;

d) replacing said bogie with a new bogie; and e) closing said latch.

DETAILED DESCRIPTION OF THE PREFERRED EMBODIMENT

Figure 1:
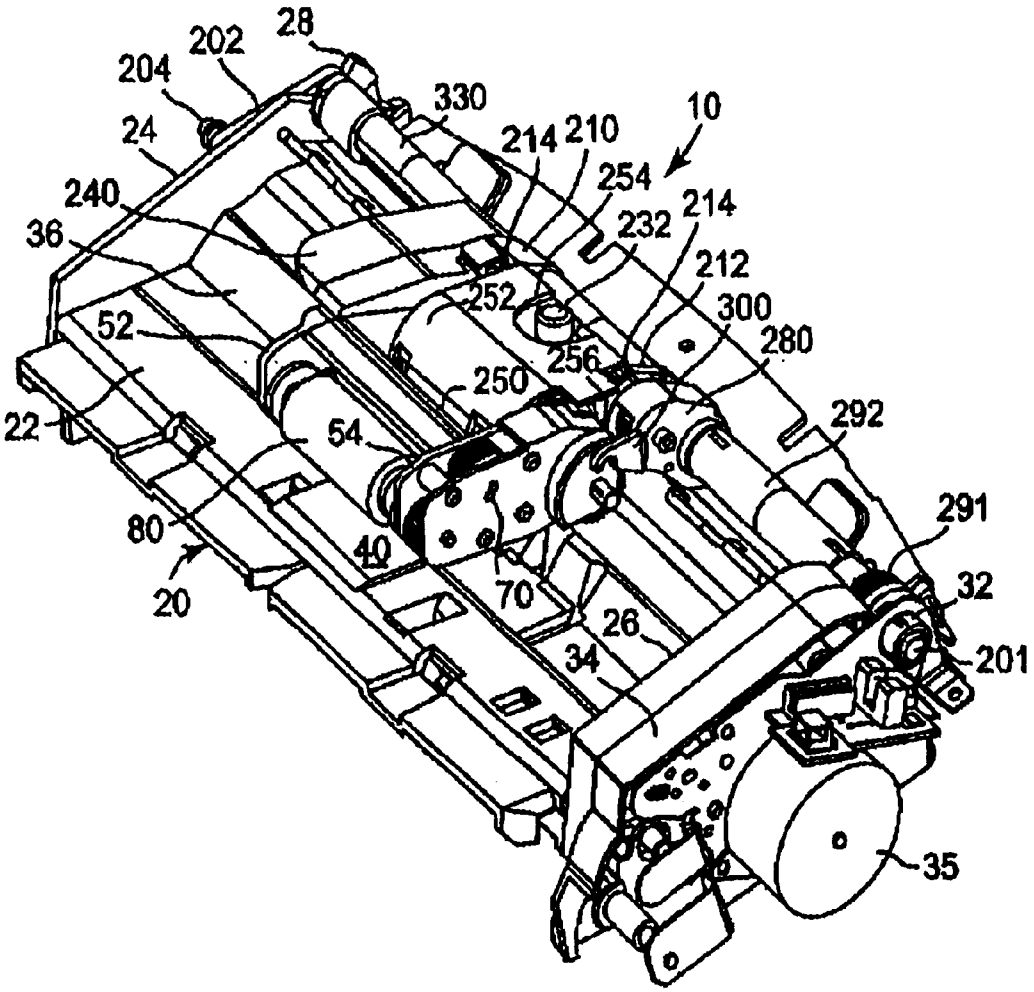
FIG. 1 is a perspective view of a single sheet feeder module which includes a media input tray shown partly in section, a modular roller support assembly, and a removable roller bogie.

The modular sheet feeder 10 seen in the perspective view in FIG. 1 is a separate unit of a document processing apparatus which includes a document processing module (not shown) such as a printer, scanner, facsimile machine or copier or combination of any of the foregoing. The sheet feeder module 10 is affixed to the document processing module (not shown) for feeding individual sheets from the top of a stack thereof to sheet transporting mechanism in the document processing module.

The sheet feeder module 10 is comprised of an input tray comprising an input frame 20 having a stack support surface 22 and spaced sides 24, 26 in the form of upstanding walls which define a sheet transport path for moving individual sheets from the top of a stack supported on a stack support surface 22 from left to right as seen in FIG. 1. The side wall 24 includes a shaft mounting cradle having a non-circular gate 28 and an integrally formed spring mounting post 30 for purposes which will be described. The other side wall 26 is provided with a bushing aperture 32 located in a motor support plate 34 attached by suitable fasteners to the wall 26. A reversible electric step motor 35 is supported on the motor support plate 34 which, with the wall 26, defines a housing for the motor and motor output gear (not shown).

The input frame 20, which may be of molded plastic as is conventional, includes a stack retard wall 36 which is angled upwardly and away from the stack support surface 22 and with a retard pad 38 positioned for engagement with the arcuate surface of a single sheet separation roller 90 and with a pad 40, preferably of cork, for engagement with a sheet pre-feed roller 80. As used herein, the term 'roller' includes single and multiple rollers and spaced or adjacent coaxially mounted wheels and equivalents for moving single sheets of media such as moveable belts trained around spaced rollers.

Figure 4:
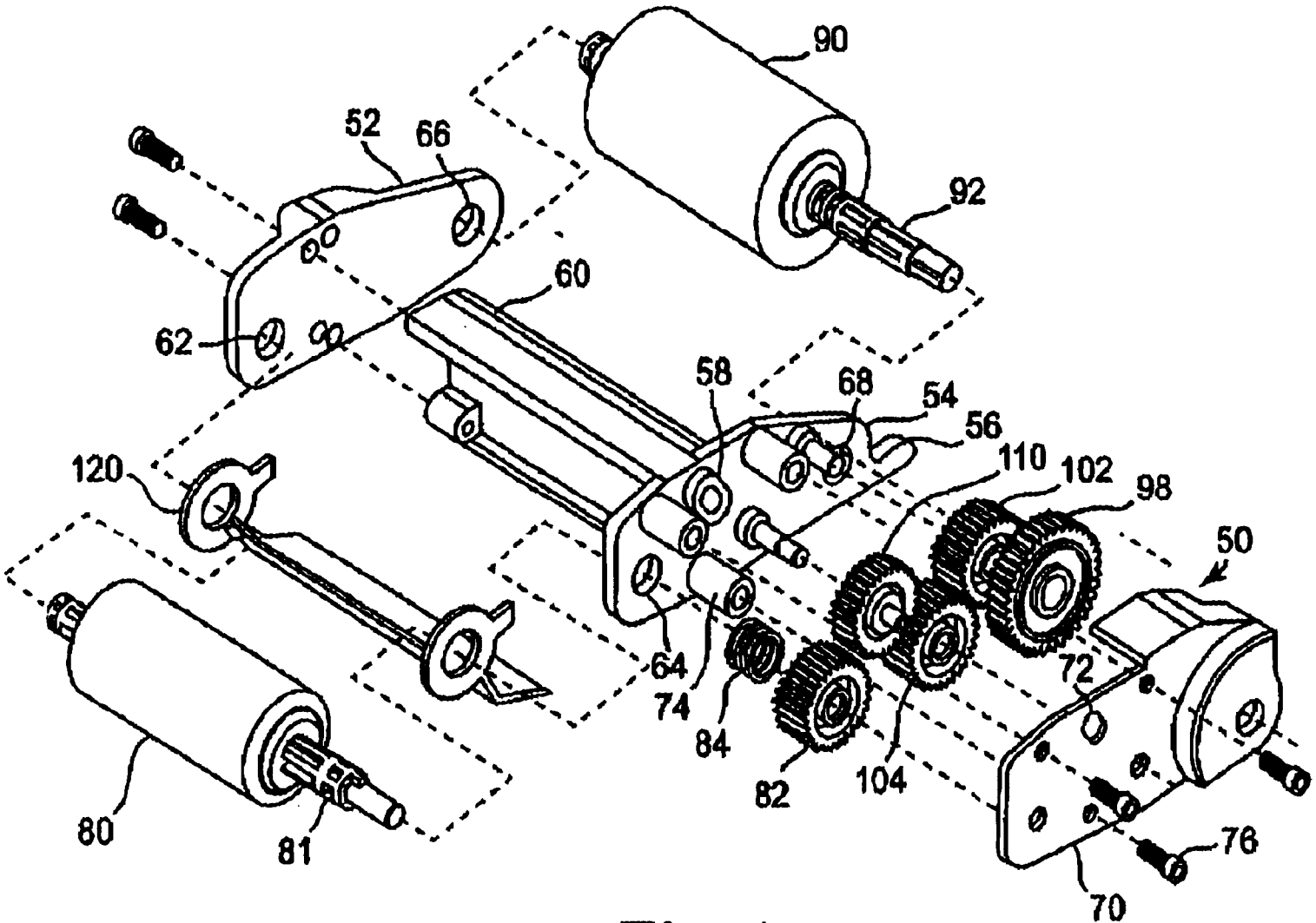
FIG. 4 is an exploded perspective view of the bogie.
Figure 5:
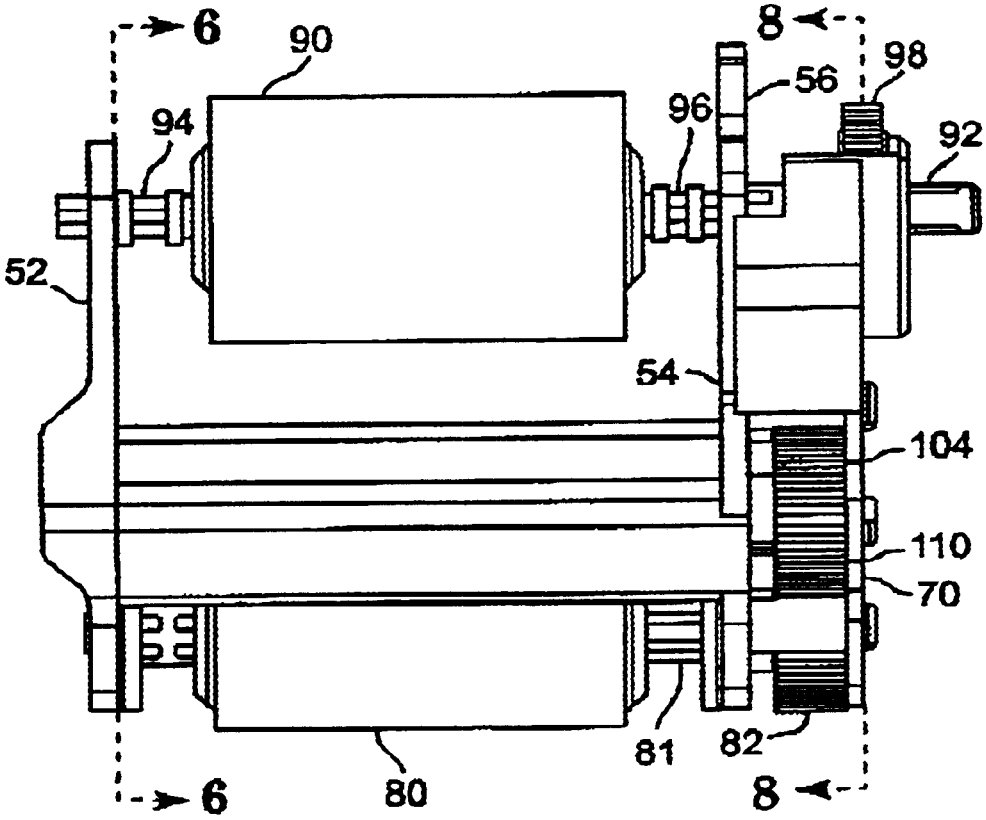
FIG. 5 is a plan view of the bogie.

A roller assembly, which may comprise a replaceable bogie, best seen in FIG. 4, comprises a frame 50 formed of spaced side members or plates 52, 54 joined by a cross piece 60 to support a pre-feed roller 80 and a single sheet separation roller 90 downstream of the pre-feed roller 80, supported on the frame 20. Side plate 54 has an integrally formed tail or lever arm 56 which extends generally parallel to a line connecting the centers of rotation of the pre-feed roller 80 and single sheet separation roller 90. The side plates 52, 54 include bearing apertures 62, 64 for a pre-feed roller support shaft and bearing apertures 66, 68 for a separation roller support axle 92. A gear retainer plate 70 is mounted on and spaced from side plate 54 by spacing posts 74 and fasteners 76. A pre-feed roller clutch gear shaft slot 58 in side plate 54 aligns with a pre-feed roller clutch gear shaft mounting slot 72 in the gear retainer 70.

The sheet pre-feed roller 80 is supported on a shaft 81 whose ends are received in the apertures 62, 64 in the side plates 52, 54, respectively. As is conventional, the pre-feed roller has an elastomeric surface or a surface texture suitable for engaging the top surface of a sheet to be removed from the stack. Similarly, the single sheet separation roller 90 is supported on an axle 92 the ends of which are received in the bearing apertures 66, 68 in the side plates 52, 54. In sheet transporting position, the separation roller 90 forms a sheet separation nip with a surface of the retard pad 38. The separation roller axle 92 has spaced support bearings 94, 96 thereon for a purpose to be described and a separation roller drive gear 98 is also mounted on the axle 92 for driving the separation roller 90. A plurality of intermediate gears 102, 104 may be provided to transmit power from the rotating separation roller 90 to rotate the pre-feed roller 80 through a pre-feed roller clutch gear 110 which preferably has elastomeric teeth permanently engaged with the separation roller drive gear 98 or with one of the intermediate gears. The clutch gear 110 is supported on a shaft, the ends of which are received in the slots 58, 72 which are preferably arcuate and are centered on the axis of rotation of a drive or intermediate gear which is continually engaged with the clutch gear 110.

Figure 6:
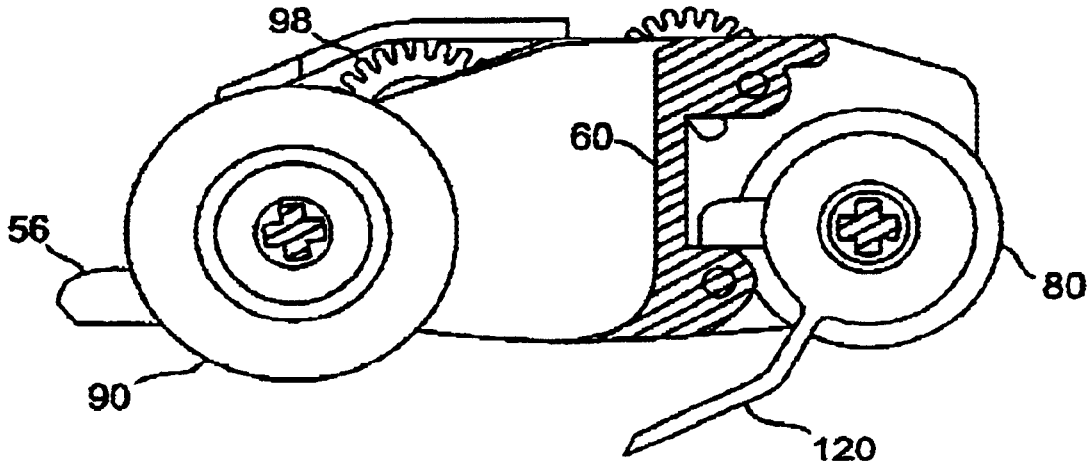
FIG. 6 is a cross sectional elevation of the bogie taken at line 6—6 on FIG. 5 showing a stack damper on the bogie.
Figure 7:
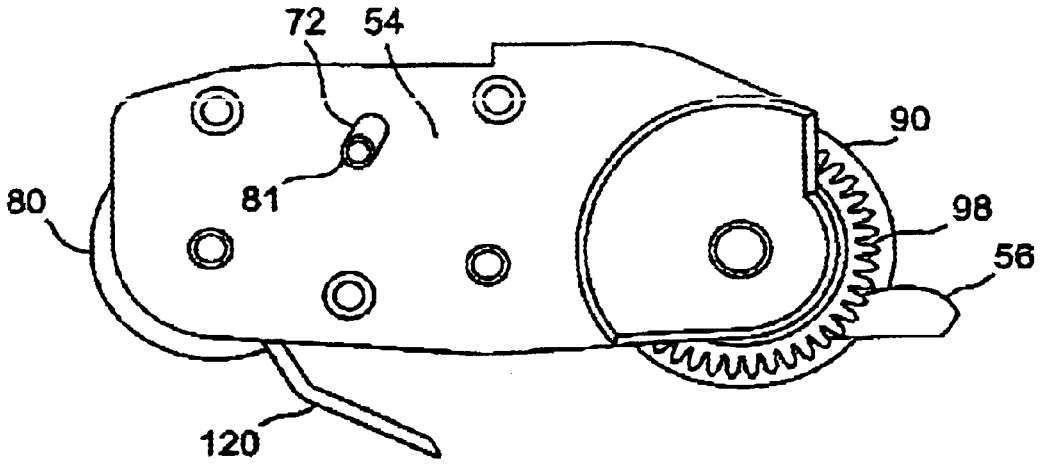
FIG. 7 is a right side elevation of the bogie.
Figure 8A:
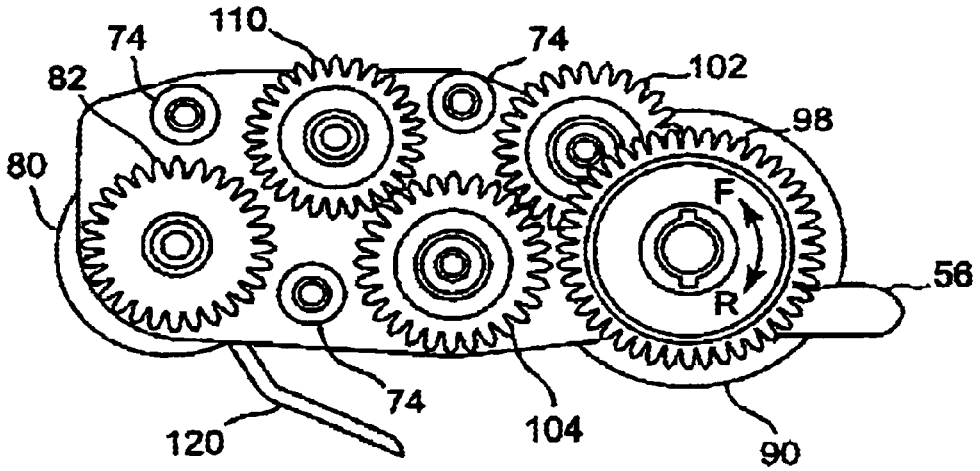
FIG. 8A is a cross sectional elevation of the bogie taken at line 8—8 on FIG. 5 showing the gear cluster and disengaged pre-feed roller clutching gear.
Figure 8B:
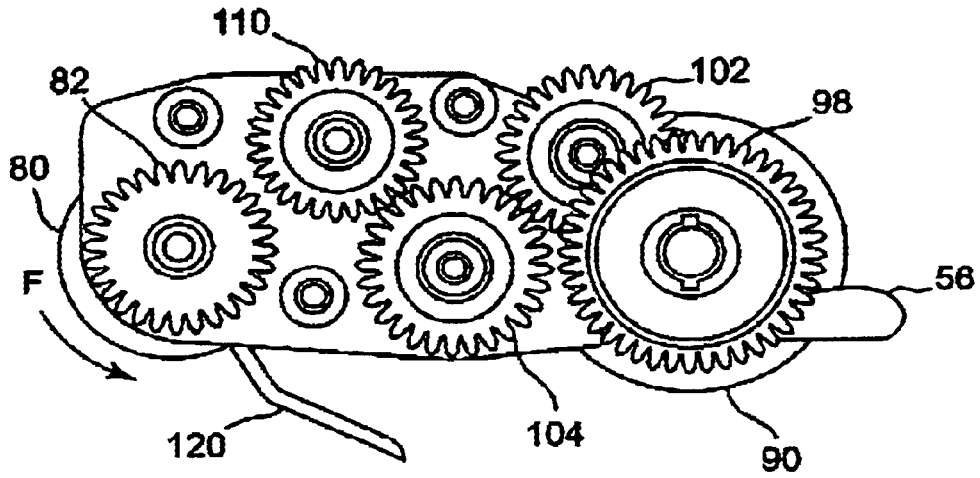
FIG. 8B is a cross sectional elevation of the bogie like FIG. 8A showing the engaged position of the pre-feed roller clutching gear.

A stack damper 120 is freely rotatable on the pre-feed roller support shaft 81, the stack damper having a surface which extends in the downstream direction of sheet movement from the pre-feed roller 80 parallel to the surface of a stack of media sheets on the support surface 22. The stack damper 120 is heavy enough to prevent buckling of thin sheets between the pre-feed roller 80 and the separation roller 90 and is free to pivot upwardly by sheet contact, particularly with heavy sheets, until it engages a stop surface on the frame such as the cross piece 60 as seen in FIG. 6. The roller frame 50 thus supports the pre-feed roller 80, single sheet separation roller 90, gears and stack damper 120, if provided, which together comprise a replaceable bogie which is supported by a modular roller support and drive assembly 200 to be described.

Figure 9:
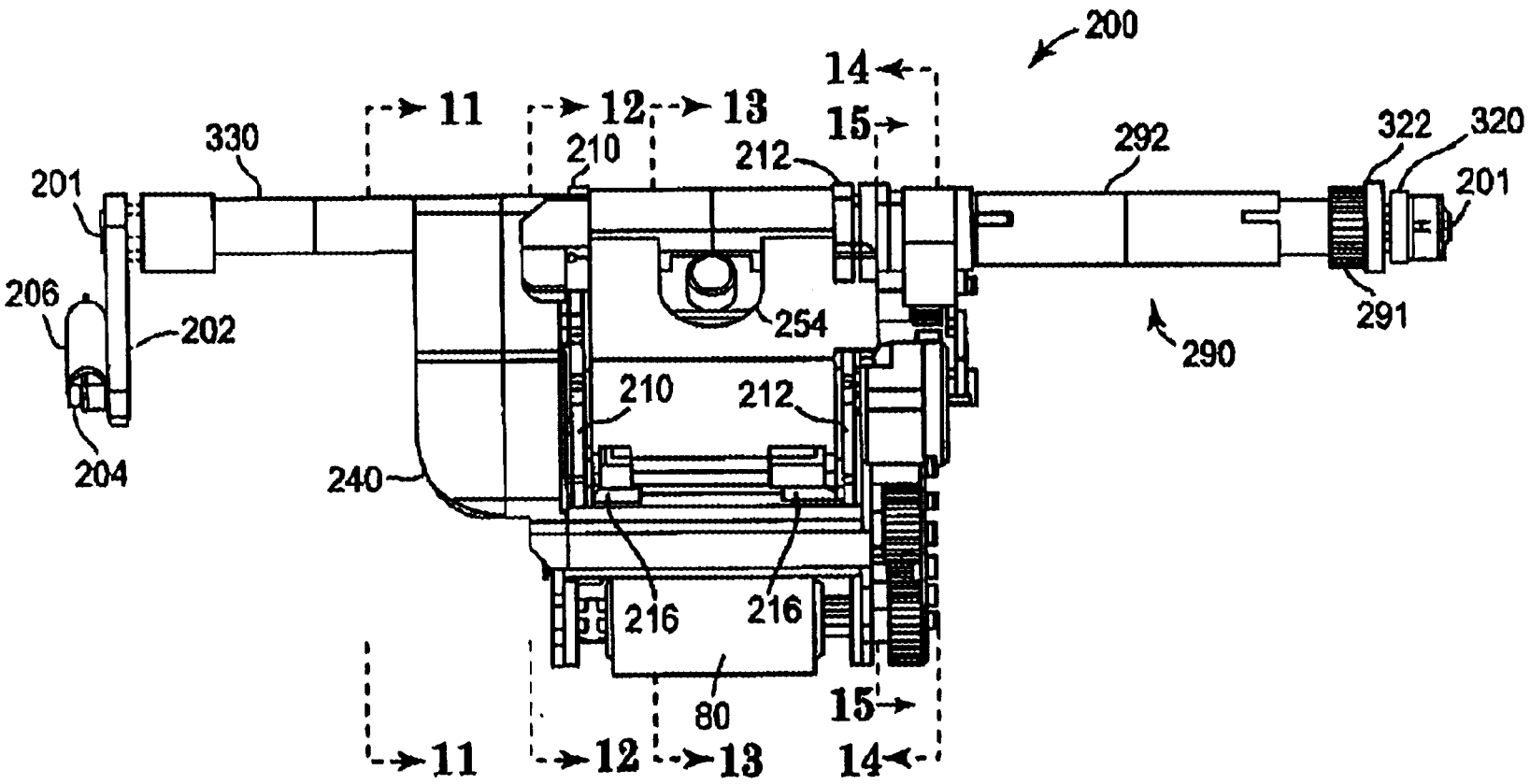
FIG. 9 is a plan view of the modular roller support assembly and bogie removed from the sheet feeder module.
Figure 10:
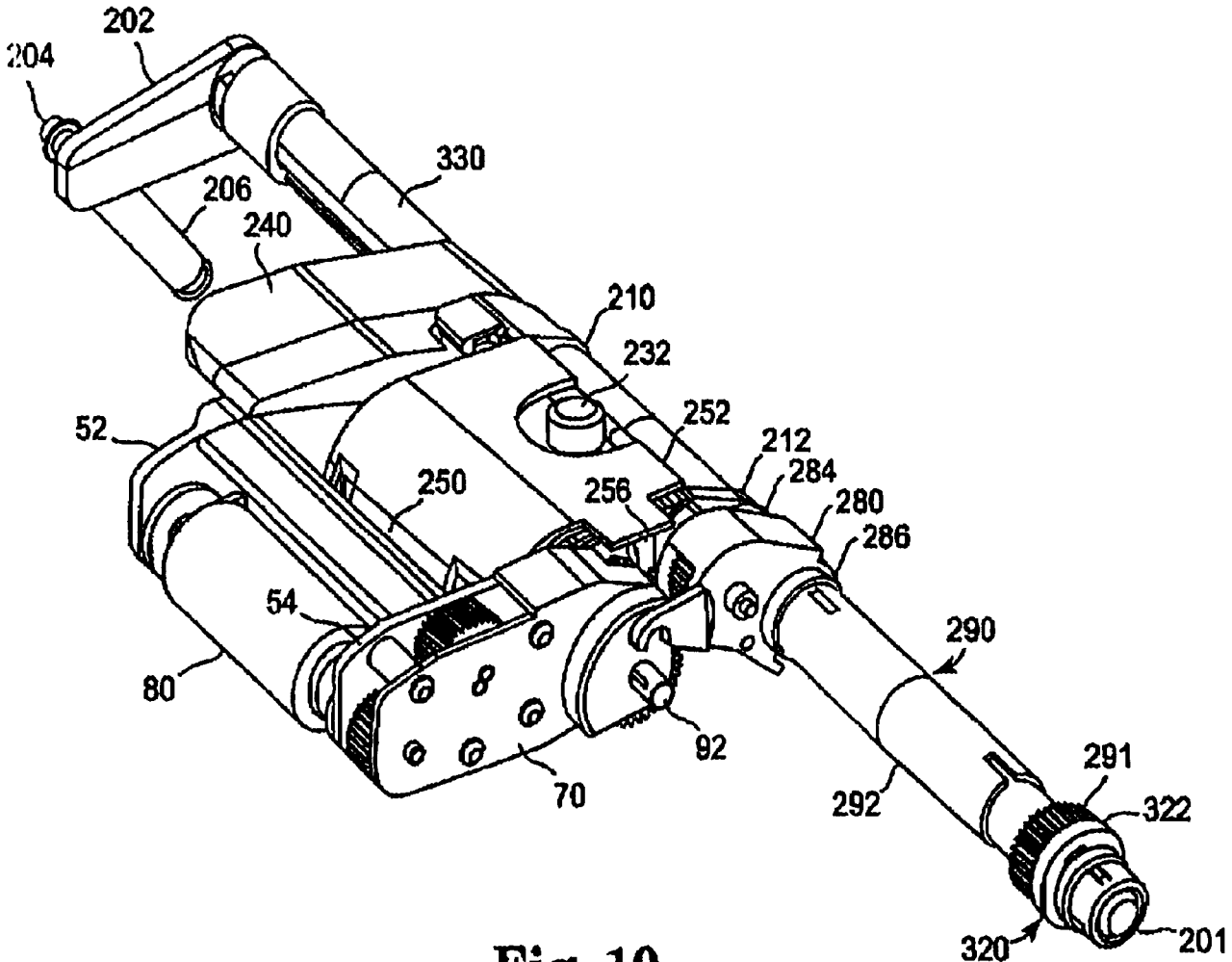
FIG. 10 is a perspective view of the modular roller support assembly.

The modular roller support and drive assembly 200, best seen in FIGS. 9 and 10, is comprised of a shaft 201 received in axially aligned shaft supports in the spaced side walls 24, 26 of the input tray 20. One of the shaft supports comprises the bushing aperture 32 into which one end of the shaft is inserted as the other end of the shaft, having a part non-circular configuration, is rotated to the appropriate position to be dropped into the other support through the non-circular shaft mounting slot 28. The shaft also has a transversely extending spring arm 202 non-rotatably affixed to the shaft, the arm 202 having a spring retainer or boss 204 protruding therefrom. A biasing member, preferably a tension spring 206, is connected between the spring retainer 30 on the side of the input tray and the boss 204 on the spring arm 202. The spring 206 passes over the center axis of the shaft 201 as the spring is tensioned.

The roller assembly 50 in the form of a replaceable bogie is supported between a pair of spaced bogie support load arms 210, 212 non-rotatably affixed to the shaft 201 as seen in FIGS. 9 and 10. The bogie support arms preferably also include spaced axially aligned support hubs 214 (FIGS. 1 and 13) for supporting a stack stop link 252. The load arms 210, 212 also preferably have spaced transversely extending stack stop guides 216 thereon and are provided with aligned bogie support apertures or slots 218, 220 in which the spaced bearings 94, 96 on the separation roller axle 92 are received to support the removable bogie on the modular roller support and drive assembly 200. A bogie retention latch 230 having a release button 232 and spaced latch hooks 234 is pivotally mounted between the bogie support arms 210, 212, the latch being biased to closed position by a bogie latch spring 236 seated between the bogie latch button and a transverse brace 211 which extends between and is connected to the load arms 210, 212. The latch hooks 234 engage the bogie support arms when the latch is closed to avoid clamping of the latch hooks onto the bearings 94, 96 of the separation roller axle 92.

Figure 11:
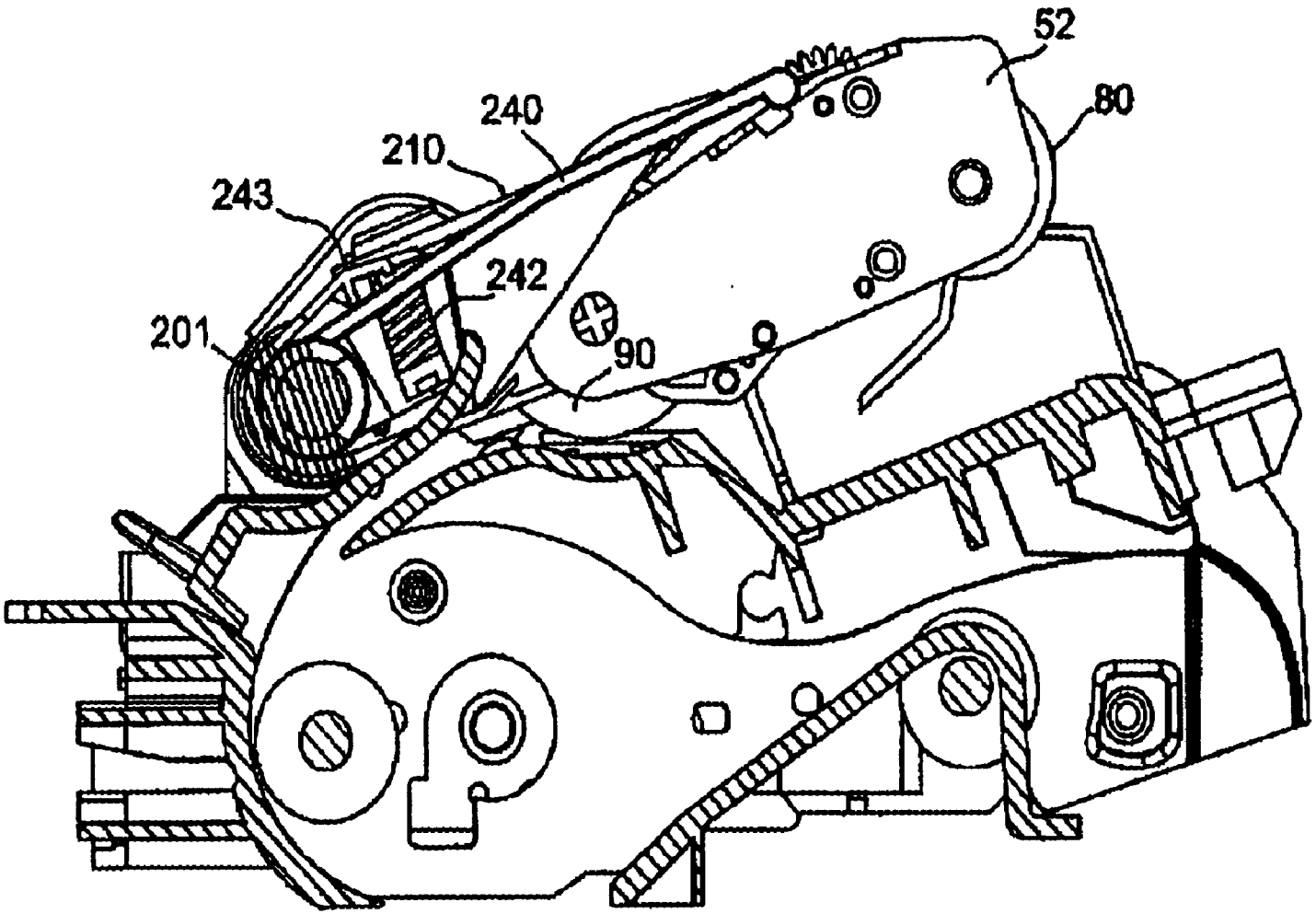
FIG. 11 is a cross sectional elevation of the modular roller support assembly taken at line 11—11 on FIG. 9 showing the bogie lifting handle.
Figure 12:
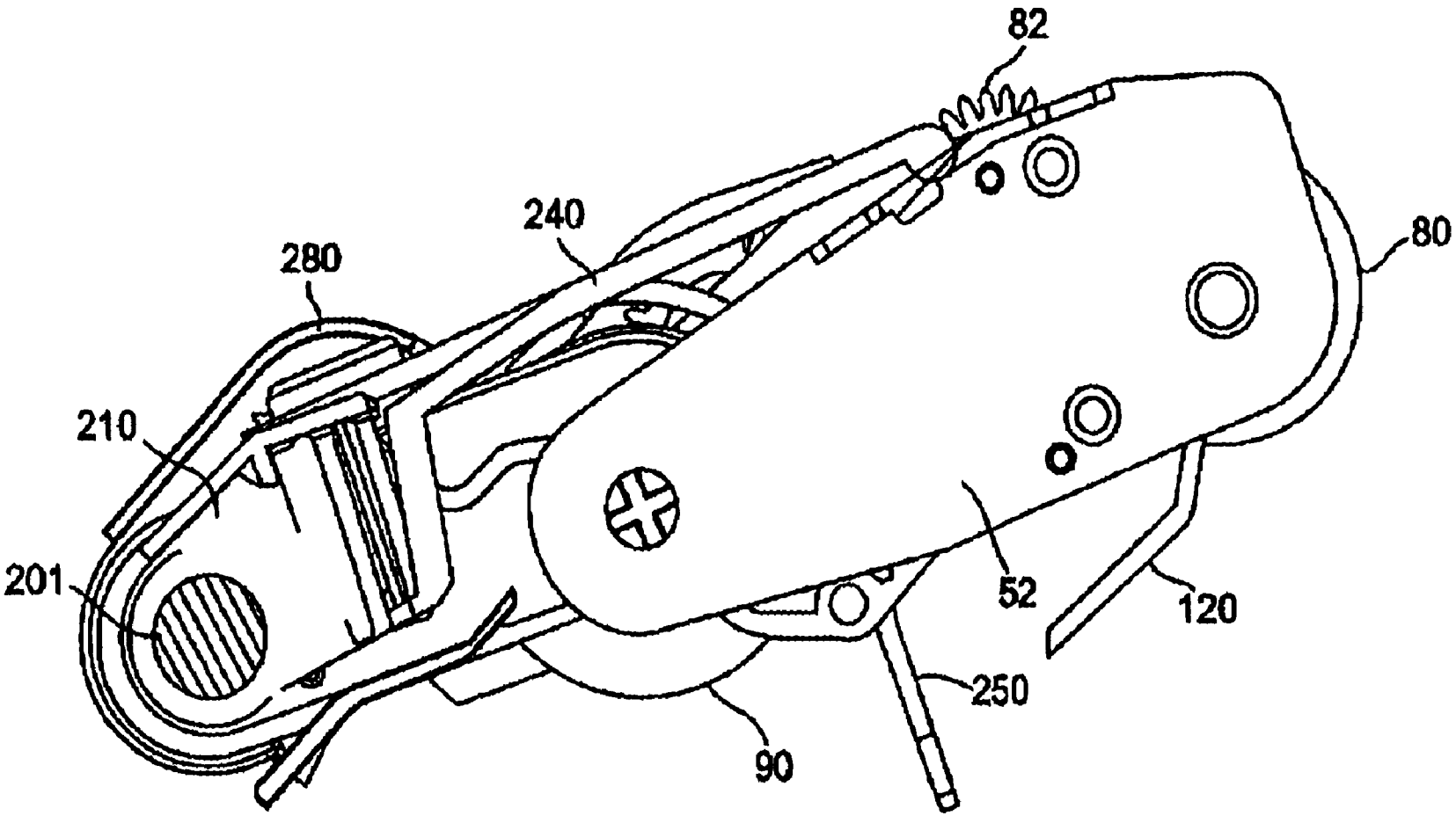
FIG. 12 is a cross sectional elevation taken at line 12—12 on FIG. 9 showing a bogie support load arm.

A bogie lifting handle 240 is preferably also provided, the handle 240 being non-rotatably affixed to the support shaft 201. As seen in FIG. 11, the lifting handle is biased to a downward position by a spring 242 engaged with a seat 243 on the load arm 210 so that lifting of the handle 240 first compresses the spring 242 before lifting the load arms 210, 212 and attached bogie. The compression spring 242 also biases the bogie downwardly through contact of the end of the handle 240 with the upper surface of the bogie frame as seen in FIGS. 1 and 10 providing the force on the pre-feed roller 80 in the media feed position and urging the frame tail or lever arm 56 upwardly against a cam surface of a follower 260 (FIGS. 14 and 16) to be described. When the follower has lifted the bogie to the up positions. The lifting handle 240 and tension spring 206 are designed with over center geometry so that the spring 206 will bias the replaceable roller assembly or bogie 50 downwardly for sheet feeding and will hold the handle and bogie in the lifted position to facilitate removal of jammed sheets and inspection of the paper path.

Figure 3:
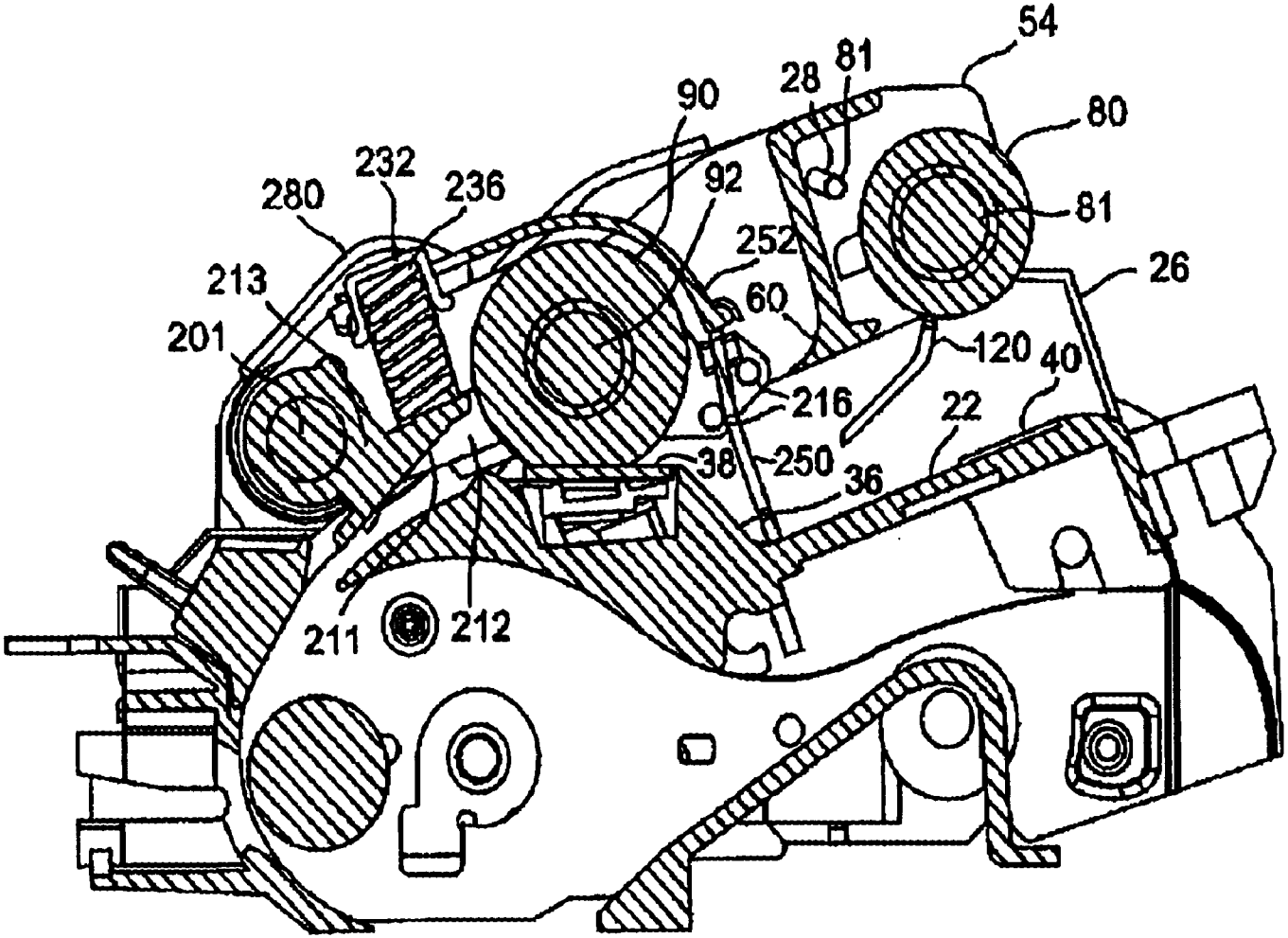
FIG. 3 is a cross sectional elevation taken at line 3—3 on FIG. 2.
Figure 13:
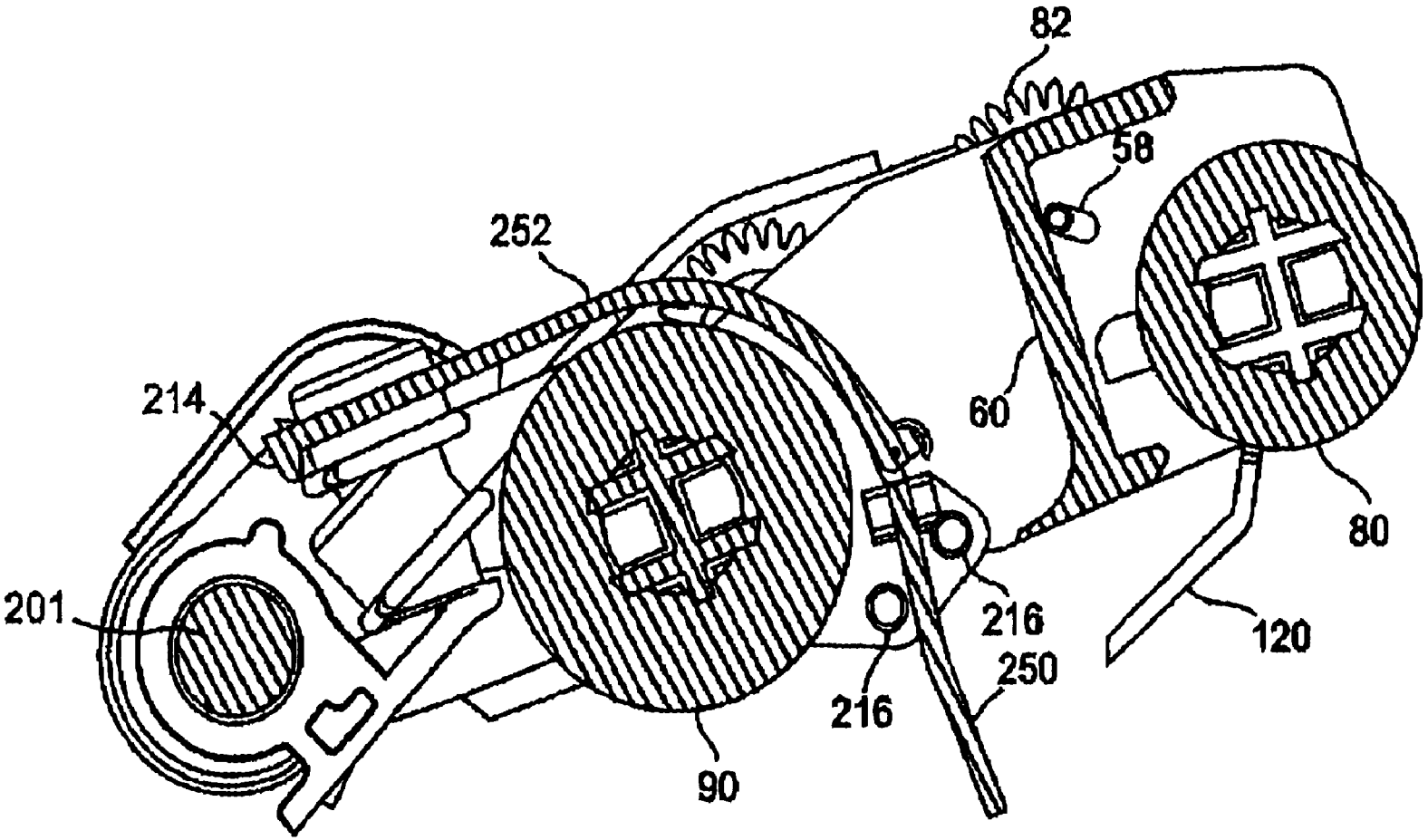
FIG. 13 is a cross sectional elevation taken at line 13—13 on FIG. 9 showing the bogie latch and the stack stop.

As seen in FIGS. 3, 13 and 16, a stack stop 250 comprising a substantially rectangular plate which is vertically guided between the stack stop guides 216 is pivotally connected to and extends from a stack stop link 252 downwardly between the pre-feed roller 80 and single sheet separation roller 90. The stack stop link 252 is pivotally attached to and supported between the spaced load arms 210, 212 such that the stack stop 250 is movable into and out of the path of movement of a media sheet downstream of the pre-feed roller 80 and upstream of the single sheet separation roller 90. A downwardly extending leg 256 is integrally formed on the stack stop link 250 for engagement with a follower 260 to lift and lower the stack stop 250.

As seen best in FIG. 16, the follower 260, having a pivot aperture 262 therein, is pivotally mounted on a follower support post 222 received in the aperture 262, the post extending outwardly from the load arm 212 in a direction parallel to the axis of the support shaft 201. The follower 260 has a point 264 and a cylindrical first cam surface 266 (FIG. 16A-3) which engages the bogie tail lever arm 56 as the follower 260 pivots on its support post to partly raise the bogie and pre-feed roller 80 supported thereon relative to the stack support surface 22 in the tray 20 when a stack of sheets is to be inserted against the stack stop 250. The follower 260 also has a second cam surface 268 (FIG. 16C-1) which engages the leg 256 on the stack stop link 252 for raising and lowering the stack stop into and out of sheet blocking position. A third cam surface 270 (FIG. 16C) on the follower 260 is provided for engagement with the bogie tail lever arm 56 and is used for test purposes not relevant herein when the single sheet feeder module is not installed on the document processing module. The follower 260 also includes an axially protruding portion in the form of a pin 272 for a purpose to be described.

Figure 14:
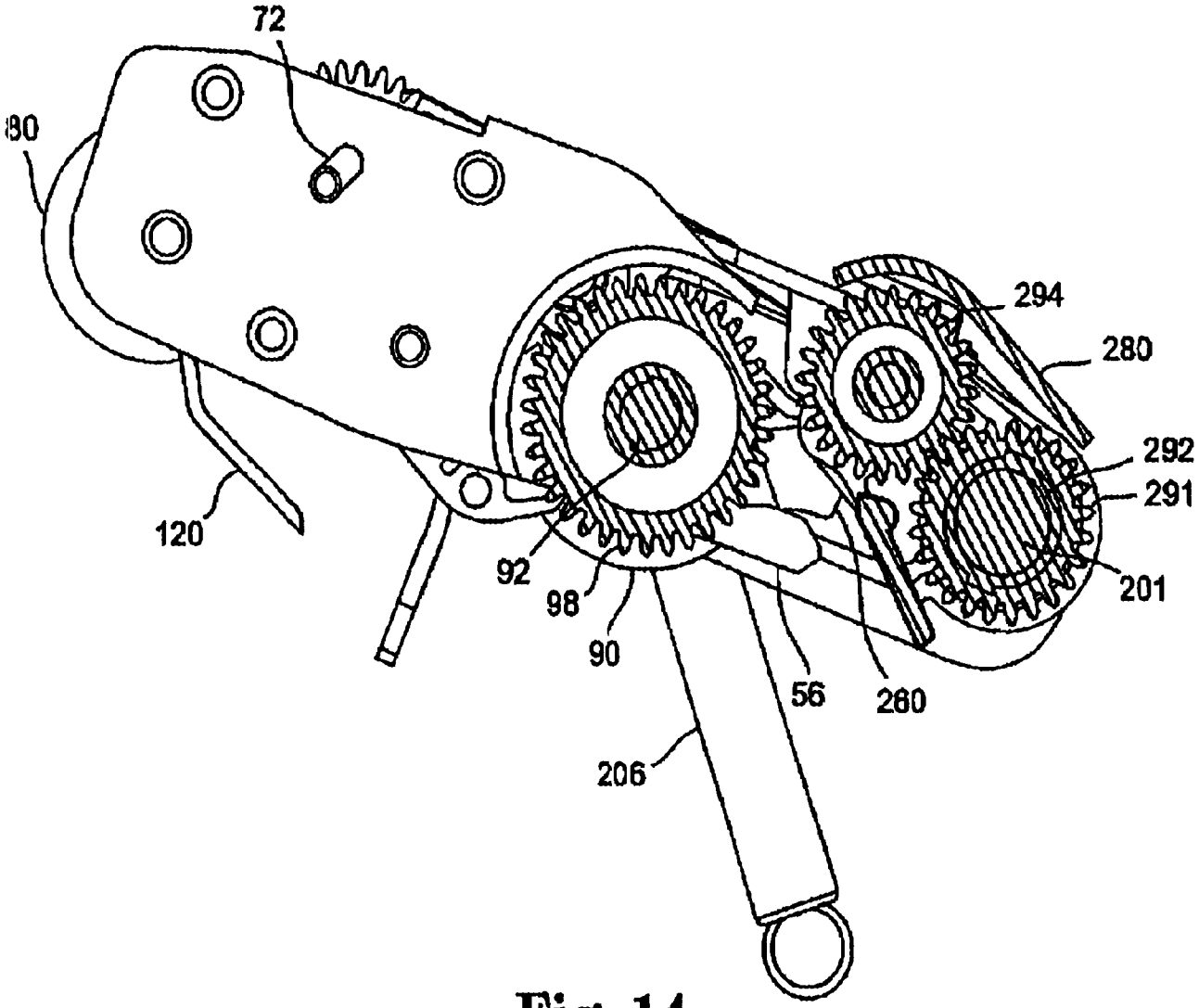
FIG. 14 is a cross sectional elevation taken at line 14—14 on FIG. 9 showing the main clutch gear disengaged from the separation roller drive gear.
Figure 15:
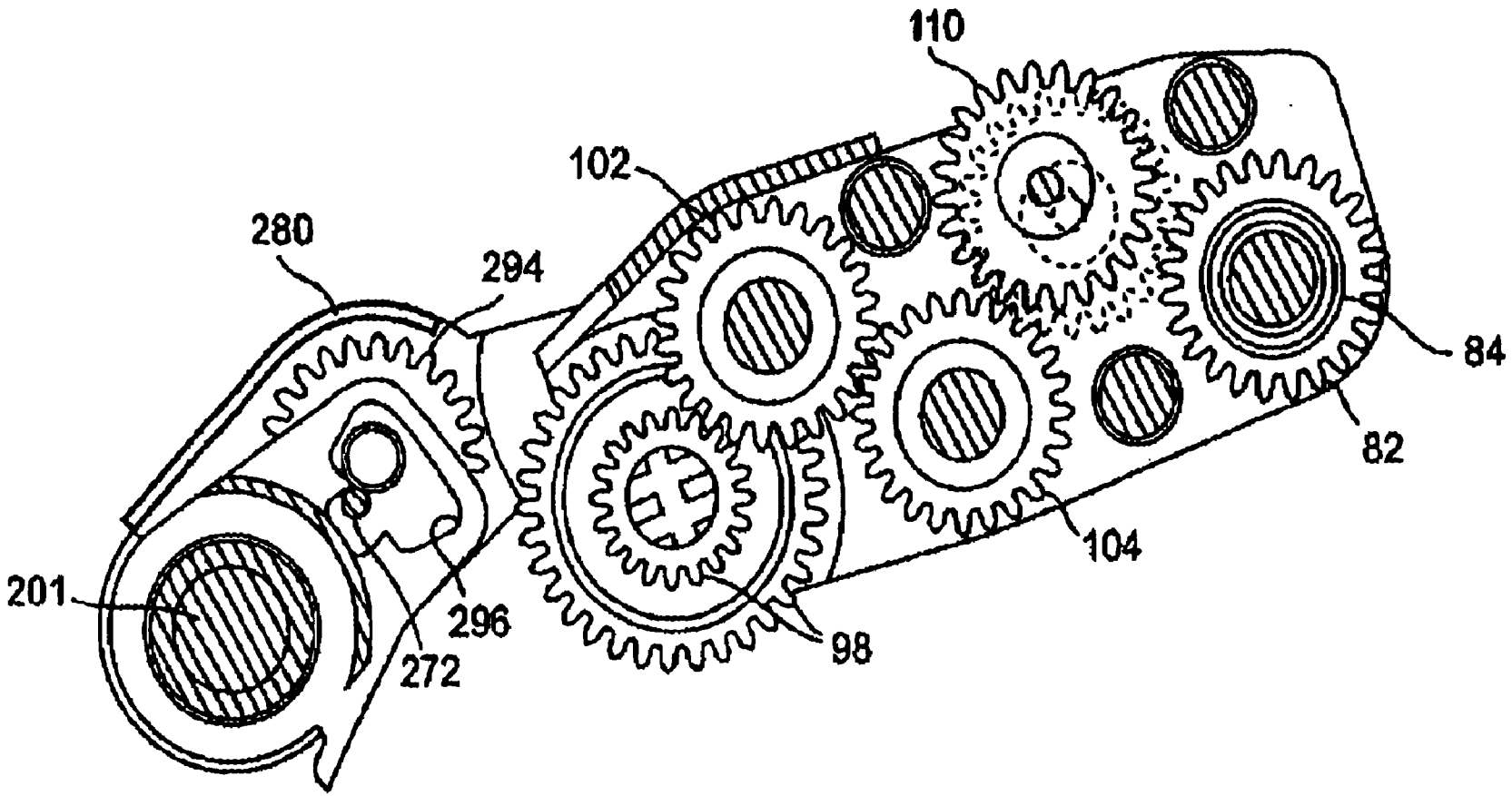
FIG. 15 is a cross sectional elevation taken at line 15—15 on FIG. 9 showing the follower engagement with the swing arm.

As seen in FIGS. 10, 14 and 16, modular roller support and drive assembly 200 also includes a swing arm 280 axially supported on the shaft 201 for rotation relative to the shaft 201 by spaced swing arm supports 284, 286. A power input gear assembly 290 having axially spaced gears 291 affixed to opposite ends of a sleeve 292 is mounted on the support shaft 201. One of the axially spaced gears 291 receives input power from an automatic direction finding gear drive (not shown) driven by the motor 35. The other of the axially spaced gears 291 on the input gear assembly 290 is continuously engaged with a clutch gear 294 supported on the swing arm 280. A drag spring for the clutch gear 294 may also be provided. A pocket 296 seen in FIG. 10A-3 in the side face of the swing arm 280 receives the pin 272 on the follower so that rotation of the swing arm on shaft 201 lifts the follower 260 when the input gear assembly 290 is rotated in the reverse direction of rotation by the motor 35. A motion limit hook 300 is also integrally formed on the swing arm 280 for engagement with the protruding end of the separation roller axle 92 to provide over-engagement protection between the teeth of the main clutch gear 294 and the separation roller drive gear 98 and to restrain lifting of the bogie frame 50.

Figure 2:
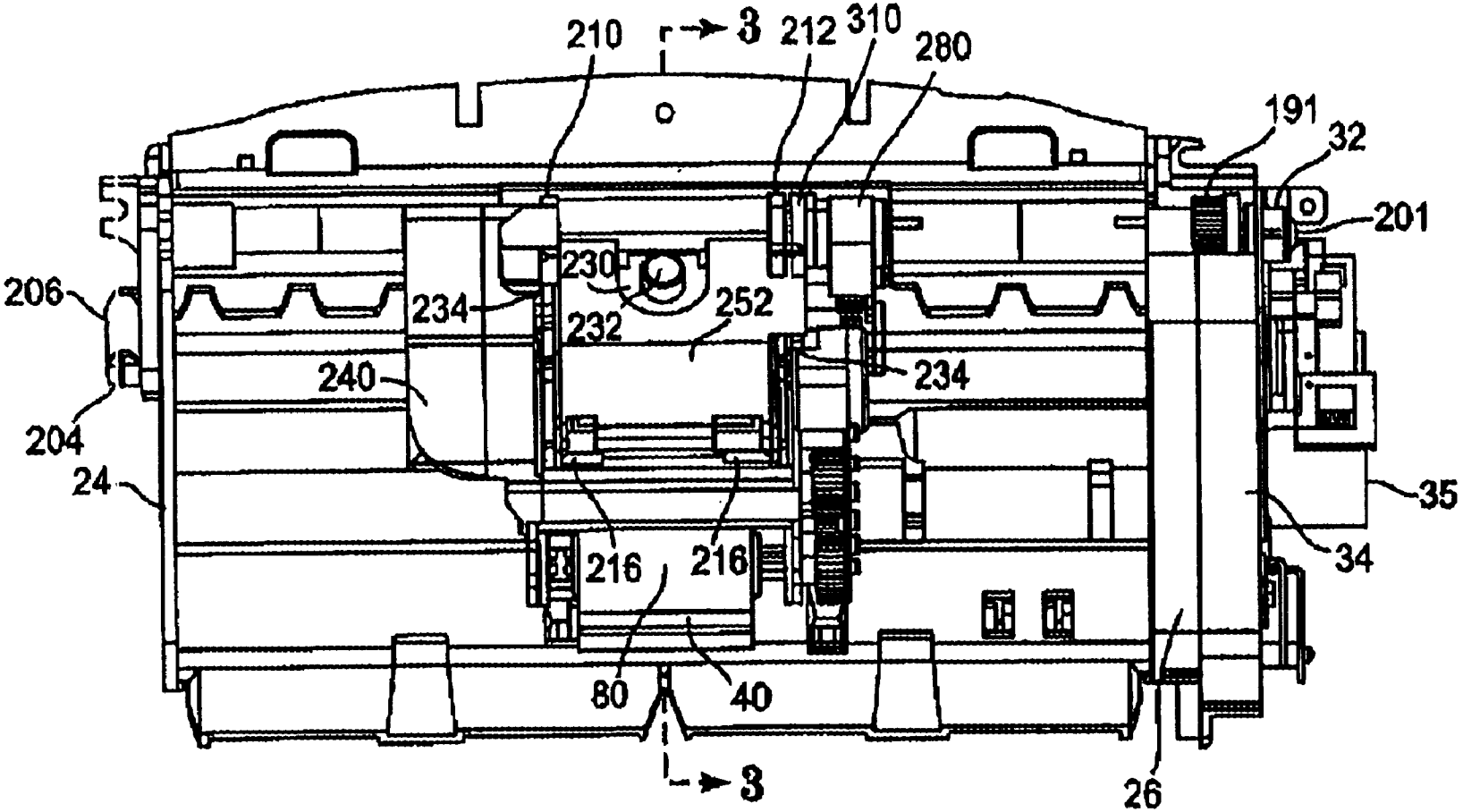
FIG. 2 is a top plan view of the sheet feeder module.
Figures 1, 16A:
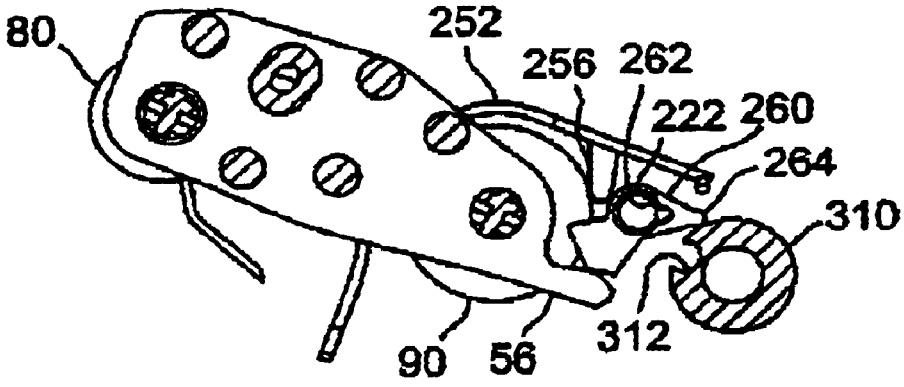
FIGS. 16A–16E show five positions of the bogie and stack stop as controlled by different positions of a cam follower moved by a cam and by a swing arm.
Figures 2, 16A:
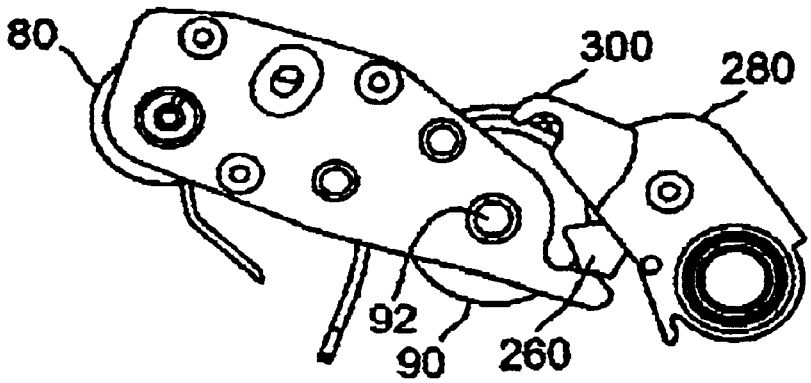
Figures 3, 16A:
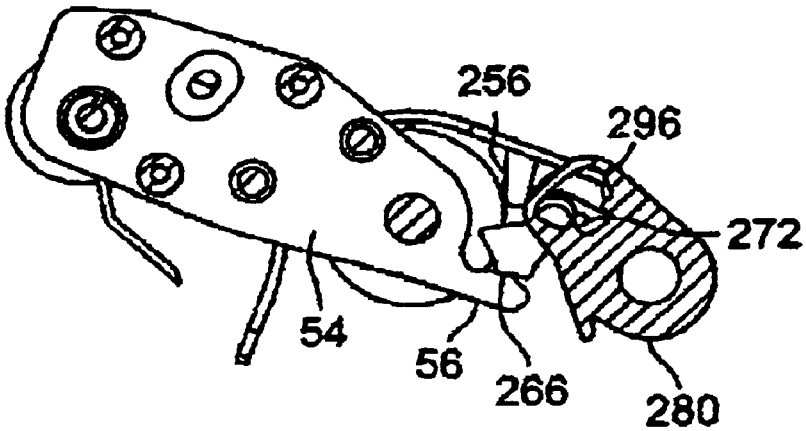
Figures 1, 16B:
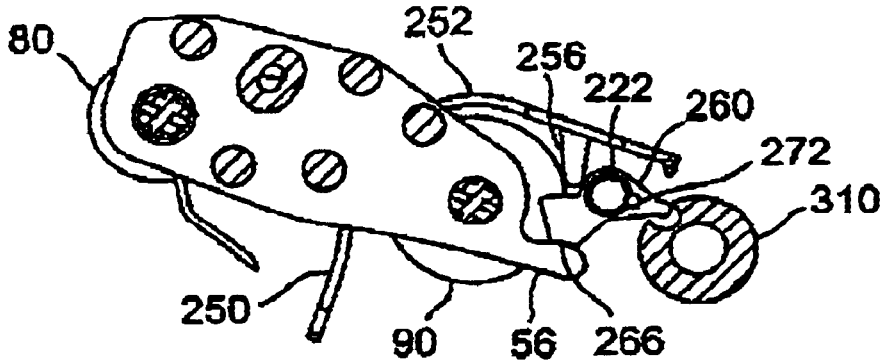
Figures 2, 16B:
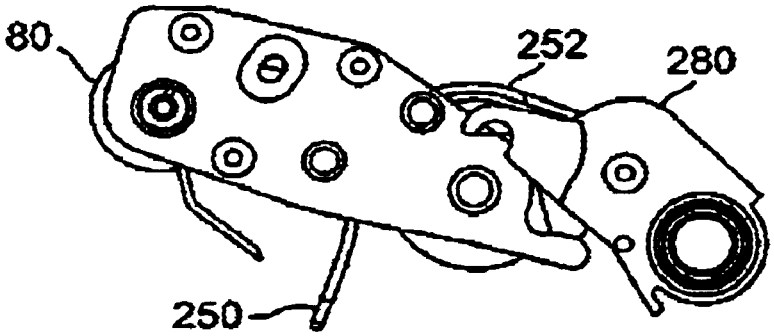
Figures 3, 16B:
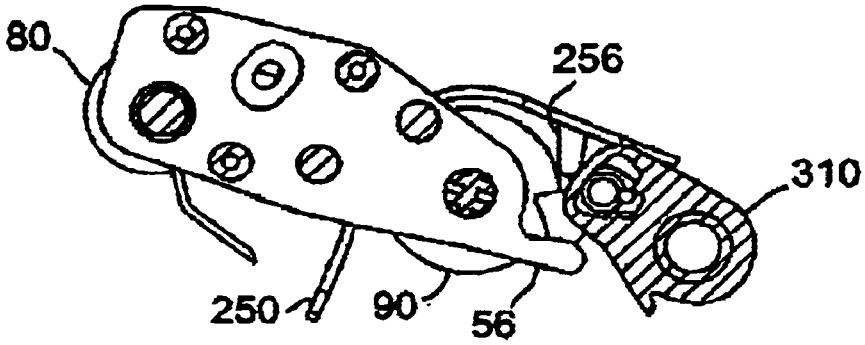
Figures 1, 16C:
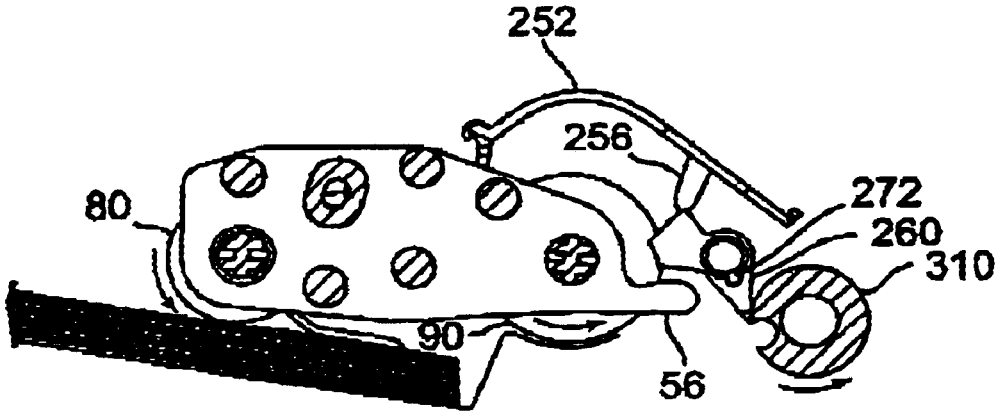
Figures 2, 16C:
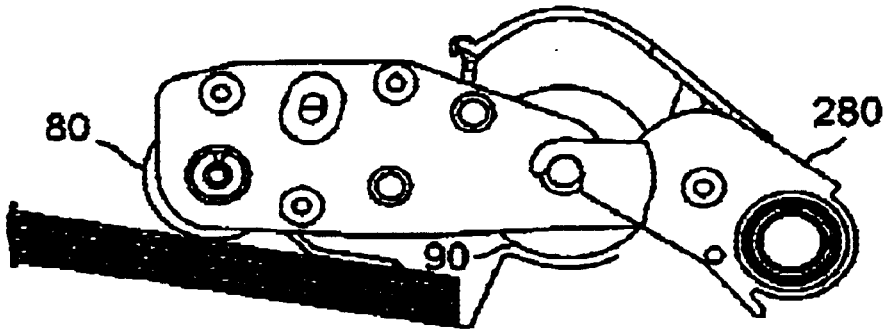
Figures 3, 16C:
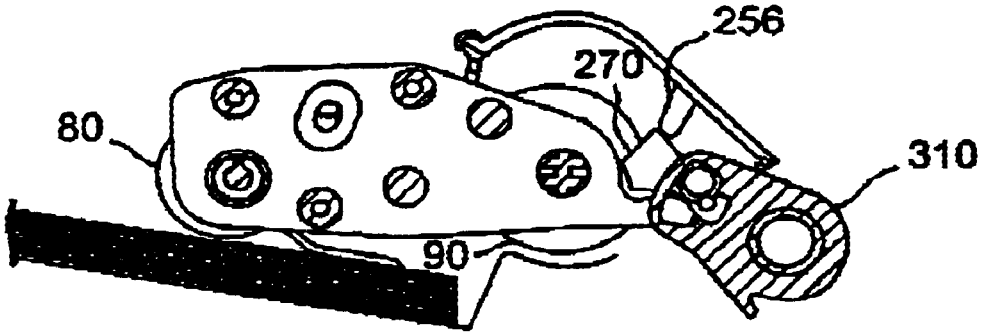

As seen in FIGS. 2 and 16, a rotary cam Geneva 310 is also affixed to the input gear assembly 290 and is positioned on the remote side of the swing arm 280 from the gears 291 and in alignment with the follower 260 so that the point 264 on the follower engages a cylindrical surface of the cam and is permitted to enter an aperture 312 in the cylindrical surface of the cam 310 when the cam rotates in the forward or counterclockwise direction as seen in FIG. 16C-1. Reverse rotation of the input gear assembly 290 causes the cam 310 to lift the point 264 from the aperture 312 to raise the bogie and lower the stack stop 250 for insertion of a new stack of media sheets.

The swing arm 280 and input gear assembly 290 including the cam Geneva 310, which are all rotatably supported on the shaft 201, are retained on the shaft by a retainer 320 suitably affixed to the shaft to axially position one of the input gears 291 in alignment with the motor output gear (not shown) and the other gear 291 is positioned for engaging the clutch gear 294 supported on the swing arm 280. As seen in FIG. 10, the retainer 320 has an arcuate, preferably cylindrical, surface 322 adjacent to the input gear 291 in a position such that the cylindrical surface 322 will be engaged by a motor output gear support which moves the motor output gear (not shown) into and out of engagement with the input gear 291 to prevent over engagement of the motor output gear and the input gear 291. The retainer 320 may be held in position on the shaft 201 by a snap spring seated in a properly axially positioned circumferential groove on the shaft 201 or by any other suitable means. A split sleeve 330 made of resilient plastic is snapped onto the other end of the shaft 201 adjacent the bogie lifting handle 240 to provide proper positioning of the lifting handle 240.

Operation

A stack of media sheets is inserted into the sheet feeder beneath the pre-feed roller 80 which is initially positioned at a distance above the stack support surface 22 to permit stack insertion until the leading edge of the stack engages the stack stop 250. Application of input power in the forward direction to the input gear assembly 290 then rotates the Geneva cam 310 and aperture 312 to a position which permits the follower finger 264 to drop into the cam aperture 312. Continued forward rotation of the motor then lifts the stack stop 250 and drops the bogie and roller 80 into sheet transporting position. The pre-feed roller 80 is under driven relative to the separation roller 90 which subsequently is under driven with respect to the sheet moving rollers in the document processing module (not shown) such that sheets are pulled through the feeder. In addition, both the pre-feed roller 80 and the separation roller 90 are clutch driven to allow them to be over driven by the media sheet. The pre-feed roller drag spring 84 places drag on the pre-feed roller drive gear to permit dwell to be built up in the pre-feed roller 80. The pre-feed roller 80 is under driven so that dwell can be accumulated during advancement of the sheet of media, the dwell then being consumed after the trailing edge of one sheet leaves the pre-feed roller 80. This dwell then allows the pre-feed roller to remain stationary so that a second sheet will also remain stationary until the trailing edge of the first sheet has just left the nip defined between the separation roller 90 and the tray 20.

Since the separation roller 90 must be under driven relative to the downstream document processing rollers (not shown) the separation roller 90 needs to be clutched in an overdrive situation to prevent abnormally high back tension from the sheet feeder module and unnecessary parasitic torque losses in the drive system caused by a sheet of paper pulled by the downstream document processing module rollers. The clutch gear 294 for the separation roller 90 therefore needs to engage when the bogie is in the down position. Also, the stack stop 250 must be in the up position whenever the rollers 80, 90 are driven to transport a sheet of media. Conversely, the clutch gear 294 for the separation roller 90 is disengaged when the bogie is up, the stack stop is down, and the system is dormant. The separation roller clutch gear 294 also allows the separation roller to free wheel when the sheet is being pulled down downstream by the document processing module rollers.

The follower finger 264 is always urged against the cylindrical surface of the Geneva cam 310 due to bias by the tail lever arm 56 on the bogie frame 50 on the cam surface 266 of the follower 260. Although a compression spring 242 engaged with the lifting arm provides this bias, various alternatives can easily be envisioned by those skilled in the art. The point on the end of finger 264 is therefore urged into the aperture 312 whenever the aperture rotationally passes in the forward direction past the finger 264 but the aperture in the cam 310 is curved to prevent entry of the point into the aperture when the cam 310 continues to rotate in the same direction after the finger 264 has exited the aperture 312. This provides four stable operational positions of the follower:

1. Stack Insertion or Up-Up—The pre-feed roller 80 is spaced from the input tray and the follower 260 and protruding pin 272 are in the up position and the point 264 engages the cylindrical surface of the cam 310 anticipating passage of the slot as seen in FIG. 16A(1). The follower 260 is upwardly biased by the bogie tail lever arm 56. The coefficient of friction between the engaged surfaces of the follower and lever arm must be low enough to ensure that the lever arm urges the follower point 264 toward the surface of the cam 310. The swing arm 280 is also in the up position as seen in FIGS. 16A(2 and 3) and a lower wall of swing arm pocket 296 is engaged with the pin 272.

Figures 1, 16D:
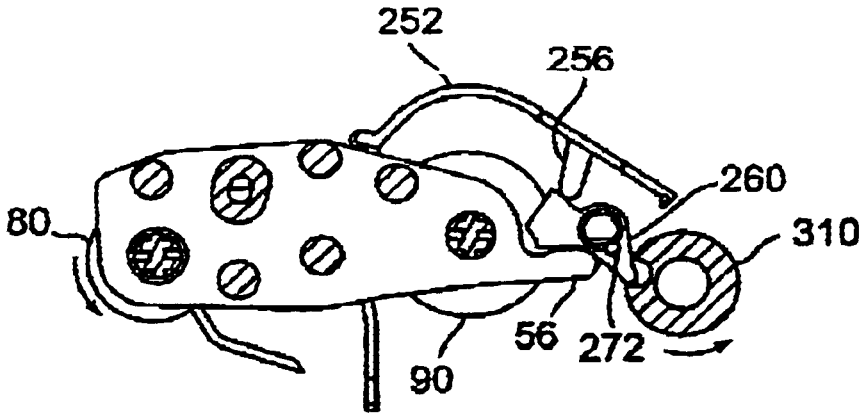
Figures 2, 16D:
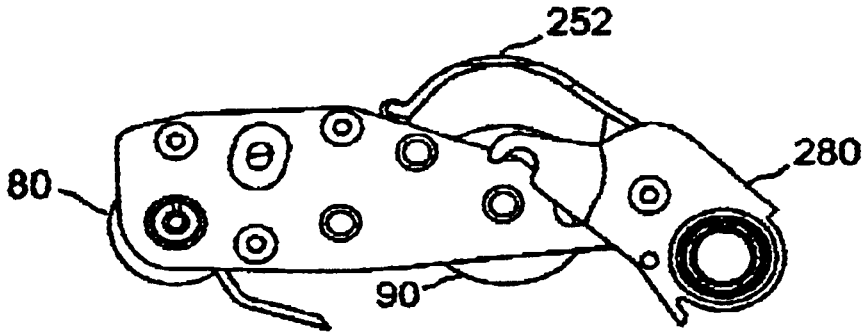
Figures 3, 16D:
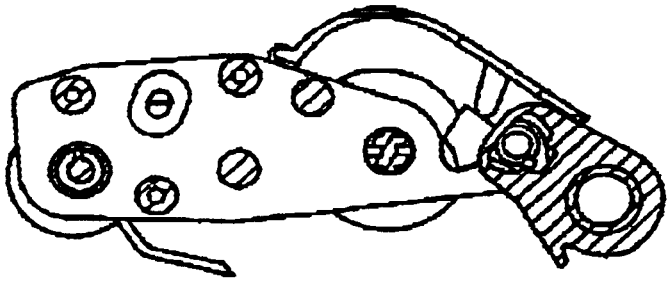
Figures 1, 16E:
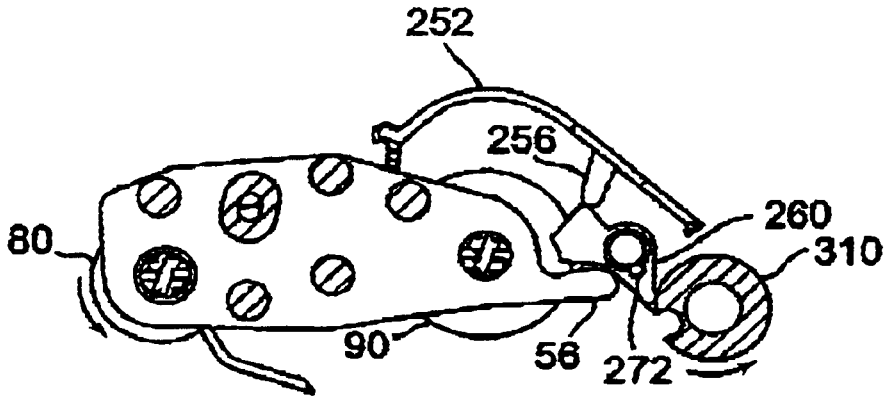
Figures 2, 16E:
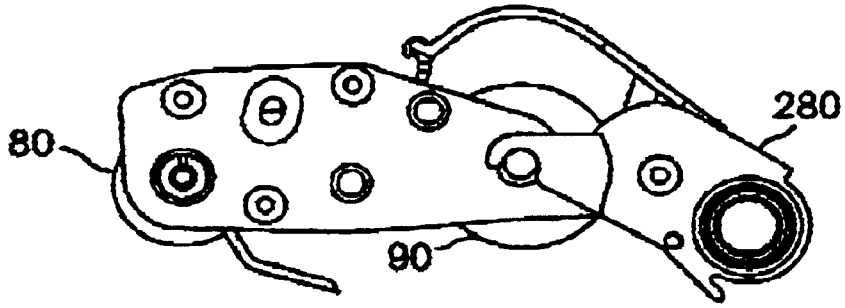
Figures 3, 16E:
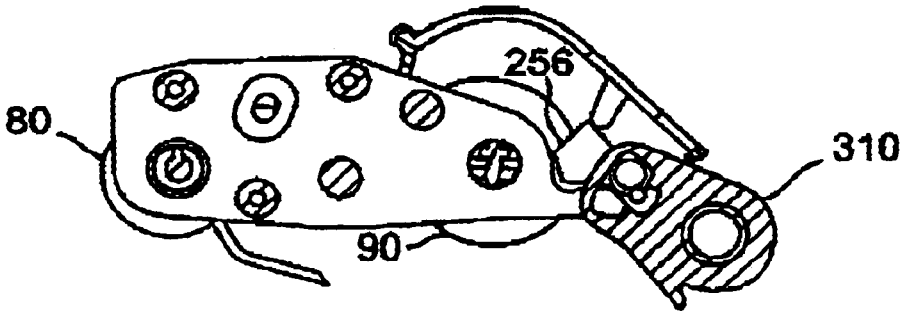

2. Up-Down—The pre-feed roller 80 is still spaced from the input tray since the follower 260 is in the up position but the point 264 has moved into the aperture 312 as seen in FIG. 16B(1). It is to be noted that the point 264 enters the aperture 312 only when the cam is rotated in the reverse direction (counterclockwise as seen in FIG. 16). The first cam surface 266 on the follower allows the follower to maintain in a stable up-down state without jumping to one of the following positions. The swing arm 280 has commenced downward movement as seen in FIGS. 16B(2 and 3) and an upper wall of the pocket 296 now engages the pin 272.
3. Operational State—This position seen in FIGS. 16C (1–3) is used to pre-feed a document from the input stack and present it to the separation nip and then drive the sheet to the scanning region of the apparatus. The pre-feed roller 80 rests on top of the input stack of media and is downwardly biased with sufficient sheet picking force by the handle 240. The follower and stack stop are in the same position as in the down states but there is clearance between the follower surface 270 and the tail lever arm 56. This allows all of the force from the lifting handle 240 to load the pre-feed roller against the input stack. The swing arm is down and engaged and the bogie clutch gear is engaged. Rotational power input then rotates the rollers 80, 90 in the forward direction.
4. Down-Up—This position is used when testing the modular roller support and drive assembly 200. The pre-feed roller 80 is in the down position as cam 310 is rotated in the reverse direction and the follower point 264 has entered the aperture 312 in the cam 310 due to engagement of the tail lever arm 56 with the first cam surface 266 of the follower pushing the point up into the aperture 312 as seen in FIG. 16D(1). The swing arm 280 is in the up and disengaged position as seen in FIGS. 16D(2 and 3) when the input is rotating in the reverse (clockwise) direction. There is enough space in the pocket 296 to allow the swing arm to rotate down into the engaged position if the input power is applied in the forward (counterclockwise) direction.
5. Down-Down—The pre-feed roller 80 and follower 260 are down and the point 264 is ready to enter the aperture 312 in the cam Geneva as seen in FIG. 16E(1). The swing arm 280 is also in the down position as seen in FIGS. 16E(2 and 3).

The second cam surface 268 on the follower engages the leg 256 of the stack stop link 252 to raise the stack stop 250 when the follower rotates to the down position seen in FIGS. 16D and E. When the follower 260 rotates to the up position, the stack stop link and stack stop are lowered as seen in FIGS. 16A and B.

Engagement of the follower pin 272 by the walls of the swing arm pocket 296 ensures that when the follower 260 is in the up position the bogie is also up and the stack stop 250 is in the down position and the main clutch gear 294 on the swing arm is not engaged with the separation roller drive gear 98. Thus, the system is in "neutral" so that the input gear assembly 290 can rotate indefinitely in the reverse direction without engagement of the drive train for the rollers 80, 90.

The drag spring 295 for the main clutch gear 294 gives the clutch gear a propensity to engage when rotating in the forward direction and the motion and the impetus to disengage when the clutch gear rotates in the reverse direction. This impetus is transferred to the pin 272 on the follower by the surfaces of the pocket 296 on the swing arm. There is adequate spacing between the pocket surfaces such that some over travel of the swing arm 280 is permitted for the overrunning clutching purposes previously explained. The surfaces of the pocket 296 are angled such that they rotate the follower about its pivotal support post 246 with the maximum amount of engagement of the point 264 with the Geneva cam 310.

The stack damper 120 on the bogie frame 50 is preferably made of plastic and has a weight heavy enough to constrain thin media sheets driven by pre-feed roller 80 to prevent buckling in the area between the pre-feed roller 80 and the separation roller 90, yet light enough to prevent it from buckling between the pre-feed roller 80 and stack damper 120. The stack damper 120 is also stopped in its upward travel to impart a slight bend to thick media sheets during sheet movement imparted by the pre-feed roller 80. The stack damper 120 falls after each sheet passes to beat down subsequent sheets of media that may be climbing up the inclined retard wall 36 reducing the tendency for more than just a few sheets to thereafter be driven over the top of the wall 36. The stack damper 120 rests by gravity on top of the top sheet of media. The bottom surface of the stack damper 120 is tangential to the outer drive surface of the pre-feed roller 80 to ensure that the surface of the stack damper is always in flat contact with the top sheet of the input stack regardless of the height of the input stack. The physical engagement of the stack damper 120 with a very stiff sheet to slightly bend it thus prevents it from moving straight from the input stack over the crest of the retard wall 36, scrubs off additional sheets from climbing over the top edge of the retard wall 36 and initiates proper form to a stiff sheet by providing a bend orthogonal to the direction of movement of the sheet. This eliminates sheet curl and other discontinuities that may exist in an axis parallel with the direction of movement of the sheet that can disturb single sheet separation.

The modular roller support and drive assembly 200 can easily be assembled to and removed from the tray 20 by detaching the spring 206. The support shaft 201 can then be rotated to the proper position so that it can be removed from its supports in the side walls of the tray 20. The mounting of the entire roller support and drive assembly 200 on a single support shaft 201 enables accurate alignment, loading and positioning of the various structural pieces mounted on the shaft.

The pre-feed roller clutch gear 110 is preferably made of elastomeric material or has elastomeric teeth thereon for quiet operation. The clutch gear 110 is supported on an axle received in slots 58, 72, the bottom saddle of which prevents over engagement of the clutch gear with the pre-feed roller drive gear 82. When the pre-feed roller 80 is over driven, the clutch gear 110 moves upwardly until its teeth disengage from the pre-feed roller drive gear 82. The slots are angled or preferably arcuate such that the clutch gear never disengages from the intermediate drive gear with which it is engaged. The use of elastomeric teeth on the clutch gear 110 has been found to significantly reduce objectionable clicking noises created when clutching gears made out of hard plastic materials are moved into engagement with the driven gear.

Persons skilled in the art will also appreciate that various additional modifications can be made in the preferred embodiment shown and described above and that the scope of protection is limited only by the wording of the claims which follow.

Parts List 10007121
Document Processing apparatus
Document processing module
Sheet feeder module 10
Input chassis or frame 20
Stack support surface 22
Sides—spaced walls 24, 26
Shaft mounting slot 28 in one side
Spring retainer 30 on one side
Shaft bushing aperture 32 in other side
Motor support plate 34 supporting motor 35 on other side defines drive gear housing containing motor swing (gear support) arm—not shown
Retard wall 36
Top of Form/Bottom of Form TOF/BOF sensor—not shown
Separation roller retard pad 38
Cork pad 40 engages pre-feed roller
Bogie Frame 50
Side members or plates 52, 54
Tail lever arm 56 on one side plate 54
Pre-feed roller clutch gear shaft mounting bearing slot 58 in sideplate
Cross piece 60
Bearing apertures 62, 64 for pre-feed roller support shaft
Bearing apertures 66, 68 for separation roller support shaft
Gear retainer 70
Pre-feed roller clutch gear shaft mounting slot in gear retainer
Spacing posts 74
Gear support bearing apertures/shafts
Fasteners 76
Pre-feed roller 80 & support shaft 81
Pre-feed roller drive gear 82 & drag spring 84
Separation roller 90 axle 92, spaced bearings 94, 96
Separation roller drive gear 98
Intermediate gears 102, 104
Pre-feed roller clutch gear 110 (preferably elastomeric)
Stack damper 120 (optional) rotatable on pre-feed roller support shaft holds down sheets that work their way up the retard wall
Modular roller support and drive assembly 200
Shaft 201
Spring Arm 202
Spring retainer 204
Biasing member/tension spring 206
Bogie support load arms 210, 212
Support hubs 214 for stack stop link
Stack stop guides 216
Aligned apertures or bogie support slots—not seen in drawings
Bogie latch 230 not seen
Release button 232
Spaced latch hooks 234 hold bogie separation roller support shaft in load arm slots
Bogie latch spring 236
Bogie lifting handle 240, spring 242 engages load arm210
Follower support post 246 (need drawing)
Stack stop 250
Stack Stop Link 252
Cutout 254 for bogie latch release button
Downwardly extending leg 256
Follower 260
Aperture 262 receives follower support post on load arm
Finger 264 or tang engages slot in rotary Geneva cam
First cam surface 266 (cylindrical) mates with bogie tail lever arm
Second cam surface 268 lifts/lowers stack stop
Third cam surface 270 engages bogie tail lever arm only when the single sheet feeder is not installed on the document processing device.
Pin 272 on follower received in pocket on swing arm which lifts follower in reverse
Swing arm 280
Spaced swing arm supports 284, 286
Automatic Direction Finding (ADF) gear drive including input gear assembly 290 having axially spaced gears 291 on opposite ends of sleeve 292, one engaged with clutch gear 294 engageable with separation roller rive gear between spaced supports
Drag spring 295 for clutch drive gear
Pocket 296 receives follower pin 272
Motion limit hook 300 engages protruding end of separation roller axle 92
Geneva cam 310 having aperture 312 in form of slot rotatably supported on shaft
Retainer 320 has cylindrical surface 322 that motor swing arm on motor support plate hits against for positioning to prevent over engagement of motor output and input gear 291
Split sleeve 330

What is claimed is:

1. A roller bogie for a single sheet feeder, said bogie comprising:

a) a frame;

b) a pre-feed roller rotatably supported on said frame;

c) a single sheet separation roller rotatably supported on said frame; and d) roller drive gears rotatably mounted on said frame, and e) axially aligned spaced bogie support bearings on said frame, said bearings being configured for reception in spaced bogie supports in a single sheet feeder, and said frame including a bogie positioning lever extending from said frame whereby said lever may be engaged to rotate and position said bogie about an axis of rotation of said single sheet separation roller, wherein said bogie positioning lever extends from said frame in a direction generally parallel to a line connecting the axes of rotation of said rollers.

2. The roller bogie of claim 1, wherein said frame is comprised of a pair of spaced side plates and at least one cross piece interconnecting said side plates, said pre-feed roller and said separation roller being supported between said side plates for rotation about parallel axes.

3. The roller bogie of claim 2, wherein said bogie support bearings are coaxial with said separation roller.

4. The roller bogie of claim 3, further comprising a gear retainer affixed to one of said side plates, said gears being mounted between said gear retainer and said one side plate.

5. The roller bogie of claim 4, further comprising a pre-feed roller drive gear connected to said pre-feed roller and a pre-feed roller clutch gear engageable with said pre-feed roller drive gear and wherein rotary power delivered in a forward direction to said gears causes said clutch gear to engage with said pre-feed roller drive gear to rotate said pre-feed roller in a sheet delivery direction.

6. The roller bogie of claim 5, wherein said pre-feed roller clutch gear is mounted on an axle received in slots in said gear retainer and said one side plate, said slots having seats which are engaged by said axle to prevent over engagement of said clutch gear and said pre-feed roller drive gear.

7. The roller bogie of claim 6, wherein rotary power delivered in a reverse direction to said gears causes said clutch gear to disengage from said pre-feed roller drive gear.

8. The roller bogie of claim 7, wherein said pre-feed roller is connected by said gears to said separation roller such that said pre-feed roller is under driven in said forward direction at a surface speed slower than the surface speed of said separation roller.

9. The roller bogie of claim 8, further comprising a drag spring frictionally dragging between said side plate and said pre-feed roller to build up dwell.

10. The roller bogie of claim 9, wherein said slots extend in a direction such that said clutch gear disengages from said pre-feed roller drive gear during rotation of said gears in a reverse direction and engages with said pre-feed roller drive gear during rotation of said gears in a forward direction.

11. The roller bogie of claim 10, wherein said slots are configured such that said clutch gear is continuously engaged with another one of said gears.

12. The roller bogie of claim 11, wherein said clutch gear has elastomeric teeth thereon.

13. The roller bogie of claim 8, wherein said roller drive gears include a separation roller drive gear and further comprising at least one intermediate gear engaged with said separation roller drive gear and with said pre-feed roller clutch gear.

14. The roller bogie of claim 1, further comprising a stack damper pivotally mounted for rotation about the axis of rotation of said pre-feed roller, said stack damper having a surface which extends in the downstream direction of sheet movement from said pre-feed roller parallel to the surface of a stack of media sheets.

15. The roller bogie of claim 14, wherein said stack damper has a weight heavy enough to prevent buckling of thin media sheets, said stack damper being restrained in upward movement by said frame to impart a slight bend to thick media sheets during sheet movement imparted by said pre-feed roller.

16. The roller bogie of claim 1, wherein said bogie positioning lever is spaced from said line connecting the axes of rotation of said rollers.

17. A method of replacing sheet transport rollers in a sheet feeder comprising the steps of:

a) providing a roller bogie having sheet transport rollers thereon, b) mounting said bogie on bogie support structure in a sheet feeder, said support structure securely holding said bogie on said support structure;

c) releasing said bogie by manually depressing a button to open an aperture on said bogie support structure and removing said bogie from said sheet feeder apparatus; and d) replacing said bogie with a new bogie by inserting support structure on said bogie into said aperture and releasing said button to hold said bogie in operative position in said sheet feeder.

18. The method of claim 17, wherein said bogie is pivotally moveable in said support aperture with respect to said sheet feeder.

19. The method of claim 18, further comprising the step of moving said bogie and bogie support on said sheet feeder to expose said bogie for replacement.

20. The method of claim 19, wherein said bogie and bogie support are pivotally moved with respect to said sheet feeder to expose said bogie for replacement.

* * * * *